United States Patent [19]

Wolfe

[11] Patent Number: 4,938,413

[45] Date of Patent: Jul. 3, 1990

[54] COLLAPSIBLE BOXES

[76] Inventor: Steve Wolfe, 2024 Argyle, Apt. E, Los Angeles, Calif. 90068

[21] Appl. No.: 316,427

[22] Filed: Feb. 27, 1989

[51] Int. Cl.[5] ..... B65D 5/42

[52] U.S. Cl. ..... 229/101; 229/920; 229/DIG. 2; 229/DIG. 3; 229/DIG.4; 493/58; 493/185

[58] Field of Search ..... 229/101, 920, DIG.2, 229/DIG. 3, DIG. 4, 23 R; 493/58, 59, 160, 185; 206/602; 220/62

[56] References Cited

U.S. PATENT DOCUMENTS

| | | | |
|---|---|---|---|
| 1,876,063 | 9/1932 | Kronenberger | 229/DIG. 4 |
| 2,486,563 | 11/1949 | Jorgensen | 220/62 |
| 2,747,380 | 5/1956 | Ridnour | 229/101 |
| 4,160,519 | 7/1979 | Gorham | 229/DIG. 3 |
| 4,284,227 | 8/1981 | Corey | 229/DIG. 4 |
| 4,694,954 | 9/1987 | Moss | 229/DIG. 4 |
| 4,817,803 | 4/1989 | Risucci | 229/DIG. 4 |

FOREIGN PATENT DOCUMENTS 997081 6/1965 United Kingdom ..... 229/23 R

*Primary Examiner*—Gary Elkins

*Attorney, Agent, or Firm*—William H. Pavitt; Ralf H. Siegemund; Natan Epstein

[57] ABSTRACT

A container having a number of walls of cardboard, fiberboard, plastic or other relatively stiff sheet material, joined along corner edges is made collapsible by providing one or more accordion folds transverse to the corner edges. Each accordion fold includes parallel crease lines on a common side of the walls, an intermediate crease line on an opposite side of the walls, and diagonally opposed areas of locally weakened stiffness in the wall material adjacent each intersection of the intermediate crease with the corner edges, such that portions of each accordion fold tend to overlap at the corner edges to facilitate bellowing action of the accordion fold.

6 Claims, 1 Drawing Sheet

COLLAPSIBLE BOXES

BACKGROUND OF THE INVENTION

1. Field of the Invention

The present invention pertains generally to the field of fiber board containers and is more particularly directed to improvements in corrugated cardboard boxes capable of being collapsed or extended along one dimension of the box.

2. Description of the Prior Art

While a great deal of inventive activity has taken place in connection with packaging materials and in particular with folded cardboard containers and boxes, this applicant is not aware of prior art directly pertinent to the concept described and disclosed below. U.S. Pat. No. 4,559,259 to Cetrelli discloses a packing laminate creased for folding into a container and provided with auxiliary crease lines adjacent to the intersection of two crease lines where the laminate material is subjected to special stresses and is thus prone to crack.

The concept of providing auxiliary crease lines to relieve stress at a primary fold line is well-known in the art, as exemplified for example, by U.S. Pat. No. 4,586,650 to Sasaki et al. which likewise provides auxiliary creases at an intersection of fold lines in containers for liquids. The auxiliary creases relieve stresses at the corners of the containers to prevent formation of cracks or pinholes and consequent leaking of the contents.

U.S. Pat. Nos. 1,758,230 and 1,482,569 to Lange disclose a corner edge or joint in a cardboard box which is formed by means of multiple crease lines including one arrangement where crease lines are formed on opposite sides of the cardboard to facilitate folding. A similar approach is taken in U.S. Pat. No. 3,526,566 to MacIlvain, Jr., et al. for folding thick paper board sheets. U.S. Pat. No. 3,899,120 to Fradkin suggests the step of crushing paper board along well-defined selected areas which permits the use of slits in the cardboard instead of wider slot cutouts in the manufacture of otherwise conventional cardboard boxes.

U.S. Pat. No. 4,284,227 issued to Corey shows an expansion file folder having an accordion pleated backbone but which, however, is devoid of any corners transverse to the direction of the fold and thus does not overcome the difficulties encountered in multi-dimensional accordion folds such as would be required to allow extension or collapse of a cardboard container having intersecting wall panels and where the extension and collapse occur in a direction parallel to the lines of intersection of these wall panels.

A need exists for such collapsible boxes, particularly such boxes made of corrugated cardboard for products which do not completely fill the container during storage and shipment but which in use require an oversize container. This, for example, is the case with litter boxes for house pets where the litter material fills only a fraction of the cardboard box. In actual use it is desirable for the walls of the litter box to rise substantially above the litter material to contain and keep the litter material from being displaced from the box by the pets. However, for purposes of shipping, storage and sales-on-shelf purposes, it is undesirable for the box to be full height due to space restrictions and inherent weakness due to the empty top space in the partly filled box so that the weight of stacked boxes is not carried by the litter filling but must instead be borne by the box walls.

SUMMARY OF THE INVENTION

This invention responds to the aforementioned need and in general may be summarized as a container having a number of walls of cardboard, fiberboard, plastic or other relatively stiff sheet material, which are joined along corner edges, and in which the container is made collapsible along a dimension parallel to the corner edges by means of one or more accordion folds transverse to that dimension. Each accordion fold includes parallel crease lines on a common side of the walls and an intermediate crease line on an opposite side of the walls, and diagonally opposed areas of weakened board in the walls adjacent each intersection of the intermediate crease with the corner edges, such that portions of each accordion fold tend to overlap at the corner edges to facilitate bellowing action of the accordion fold, so that the container is made collapsible along a dimension parallel to the corner edges.

Corrugated cardboard and similar materials are characterized in that they are easily pliable in one direction but relatively stiff in a perpendicular direction. This property is exploited in the manufacture of cardboard containers by orienting the corrugations in a cardboard blank such that the corrugations are aligned with the vertical or height dimension of the container, which gives the erected container weight bearing capability, while at the same time the cardboard blank is easily folded along vertical crease lines parallel to the corrugations to form corner edges between mutually intersecting wall panels.

A collapsible container according to this invention may be made by providing a sheet of suitable material such as corrugated cardboard sheet blank which has been cut and scored transversely to a longitudinal dimension so as to define four side wall panels and a number of flaps so that it can be folded to make a rectangular box with a bottom; one or more accordion folds are formed on the sheet by making for each fold two parallel crease lines extending longitudinally on a common side of the sheet and a third crease line intermediate to the two lines on an opposite side of the sheet; and at least partially crushing the corrugated cardboard within relatively small diagonally opposed areas adjacent to each intersection of the intermediate crease line with the transverse crease lines. The corrugated cardboard may be also similarly crushed within diagonally opposite areas at the intersection of the intermediate crease line with the edges of the sheet blank. The preferential stiffness of the corrugations is substantially destroyed by this crushing and causes the accordion fold or folds to overlap at each corner of the container when the container is collapsed vertically, greatly facilitating the bellowing action of the accordion fold at the corners of the containers when the container is collapsed or expanded in height.

The novel concept here disclosed is not limited only to corrugated cardboard but may be applied to other types of fiberboard, plastic, paper or laminated packaging materials of various types which because of inherent stiffness do not lend themselves readily to making accordion type folds in rectangular or polygonal containers having intersecting walls such as described below.

DETAILED DESCRIPTION OF THE PREFERRED EMBODIMENT

Figure 1:
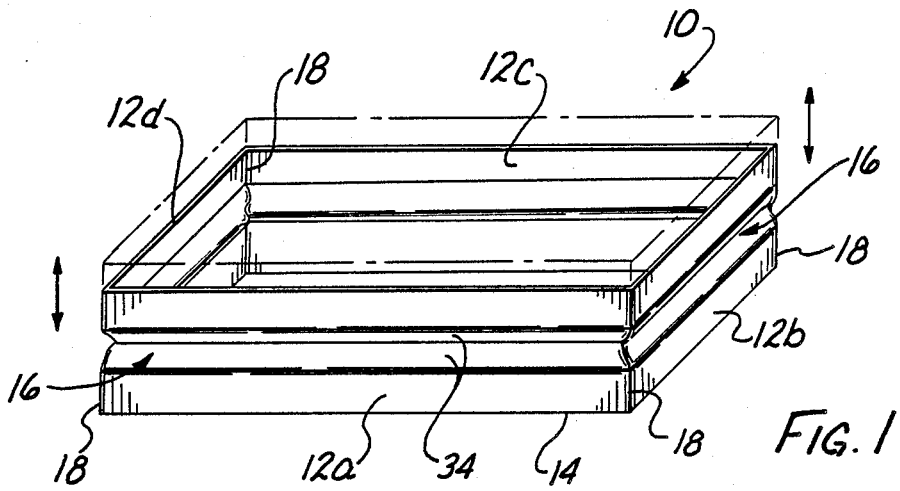
FIG. 1 is a perspective view of a typical box collapsible along a vertical dimension according to the present invention.

Turning now to the drawings, FIG. 1 shows a rectangular box 10 which includes four side walls 12*a*, 12*b*, 12*c* and 12*d*, and a bottom 14. The particular box illustrated is open topside but may of course be provided with a separate lid or cover, or in the alternative with integral panel portions foldable for making a top closure.

Each side wall intersects with two other adjacent side walls on either side to define four vertical corners 18 of the box 10. A single accordion fold 16 extends horizontally across all four side walls of the box 10.

The accordion pleat or fold 16 lies in a horizontal plane of the erected container 10 and is perpendicular to the four corner edges 18. The accordion fold 16 divides each of the four side walls into an upper wall portion and a lower wall portion, the latter connected to the bottom 14. The spacing between the upper and lower wall portions is made variable by the bellowing action of the accordion fold 16. The distance between the upper and lower wall portions can be reduced by pushing down on the upper wall portion which causes the accordion fold 16 to fold closed along its entire length along all four side walls, thus allowing the box 10 to be collapsed, i.e. reduced in height along a dimension parallel to the corner edges 18. Conversely, the box 10 may be extended in height by pulling up on the upper portions of the four side walls, causing the accordion pleat 16 to unfold and open.

Figure 2:
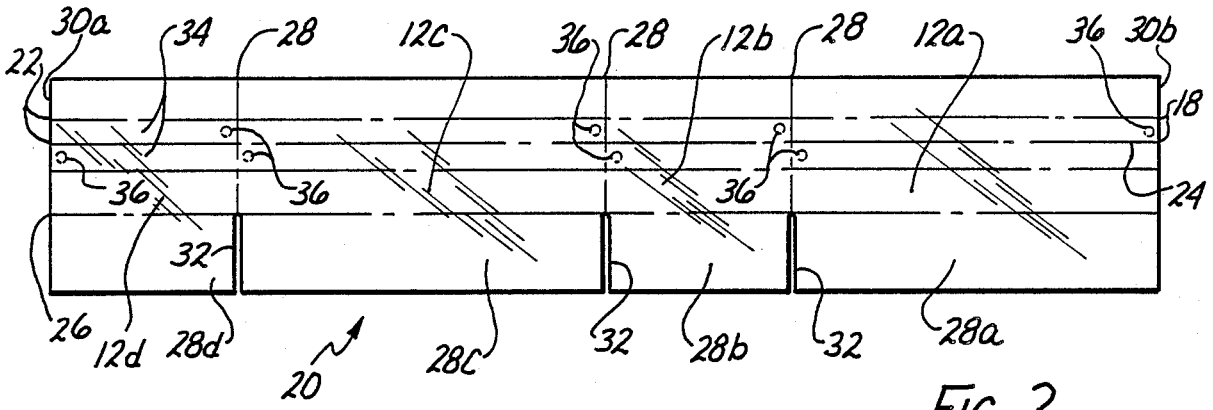
FIG. 2 is a open cardboard blank for the box of FIG. 1 showing the crease and fold lines, slots and weakened areas of corrugation.

FIG. 2 of the drawings shows a corrugated cardboard blank laid flat, which has been creased and cut for making the cardboard box 10 of FIG. 1 by folding and erecting the blank. The blank 20 has a longitudinal dimension from left to right in the drawing along which extend two parallel crease lines 22 which are formed on one side of the blank sheet 20, and an intermediate crease line 24 between the parallel lines 22 formed on the opposite side of the blank sheet 20. A further longitudinal crease line 26 separates the wall panel portion of the blank from the bottom flaps portion of the sheet blank. Three vertical crease lines 28 perpendicular to the longitudinal crease lines 22, 24 and 26 divide the blank into four side wall panels 12*a* through 12*d* and into four bottom flaps 28*a*, 28*b*, 28*c* and 28*d*. The bottom panels are folded towards each other in the erected box structure of FIG. 1 to define the box bottom 14 in a conventional manner. The blank 20 has two side edges 30*a* 30*b* on the left and right ends respectively, which during erection of the container 10 are joined together by any suitable means such as by overlapping edge portions, stapling, gluing or any other convenient means to make up one of the corner edges 18, the other corner edges 18 being formed upon folding of the crease lines 28 to construct the three dimensional box of FIG. 1. The crease lines 28 become slots 32 below the longitudinal fold line 26 so as to divide the blank into the separate four bottom panels 28*a*–28*d*.

The three longitudinal fold lines together with creases 22 and 24 define the accordion fold 18 of FIG. 1. The two longitudinal strips 34 are hinged along the common intermediate fold line 24 so as to create a V-fold projecting into the box 10 from each of the side wall as best appreciated by reference to FIG. 3. The combined width of the strips 34 determines the extent to which the erected container can be collapsed from the full expanded height of the container.

It will be readily understood that the continuous accordion fold extending the full length of the blank 20 will not by itself bend readily into a rectangular shape because of the rigid nature of the corrugated cardboard material. If the V-fold is created while the blank sheet 20 is laid flat as in FIG. 2, it would be necessary to break, cut or otherwise deform the corrugated material at the bend lines 28 in order to erect the box. Conversely, if the box 10 of FIG. 1 is erected from the blank 20 while the side wall panels are still flat and no V-fold is yet formed, it will then be very difficult or impossible to collapse the side walls in the manner shown in FIG. 1 because of the aforementioned rigidity in the vicinity of the corner edges 18.

It has been found by this applicant that the aforedescribed difficulty is readily overcome in a simple and inexpensive manner by at least partially crushing and thereby weakening the corrugations of the cardboard material within diagonally opposed areas of the strip 34 adjacent each intersection of the vertical bend lines 28 with the longitudinal hinge line 24 of the accordion fold. These areas 36 of weakened corrugation may be relatively small as for example, circular areas approximately ¾ inch in diameter in opposite quadrants at each intersection as shown in FIG. 2.

Figure 3:
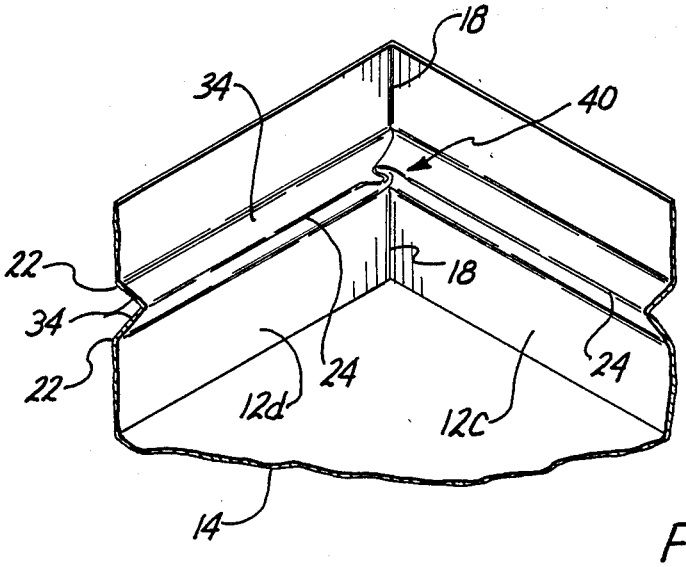
FIG. 3 is a fragmentary perspective view of the the overlapping S-fold at the corner of the accordion fold such as in the box of FIG. 1.

The crushed corrugations have greatly diminished stiffness within the areas 36 and it has been found that selectively and locally weakening the corrugations in this manner causes the V-fold to rather easily assume an overlapping S-shaped configuration at the corners of the box as shown in FIG. 3. Rather than being forced into an opposing relationship and pushed into each other when the box is folded, the V-folds on each wall panel are guided by the weakened diagonally opposite areas 36 into an overlapping relationship and an S-shaped corner fold 40 which offers relatively minor resistance to the bending of the accordion pleats 16 into the necessary rectangular configuration and also considerably facilitates the hinging and bellowing action and movement of the strips 34 about the central line 24 during extension or collapse of the side walls in the manner already indicated.

It is also within the scope of the present invention to provide four areas 36 of weakened stiffness, i.e. one in each quadrant of each intersection of the bend lines 28 and 24. In the event that only two such areas of crushed corrugation 36 are provided, it is then favorable that the areas 36 occupy the same quandrants at each of the three intersections, all as illustrated in FIG. 2.

It is furthermore advantageous to similarly provide such weakened portions 36 at each side edge 30*a* and 30*b* of the cardboard blank if the two edges are to be rigidly joined together to make up one of the corner edges 18 of the box 10. The areas 36 adjacent the side edges should be on mutually opposite sides of the intermediate bend line 24 and desirably in the same relative positions or diagonal arrangement as the areas 36 associated with the bend lines 28.

The manufacturing process of the improved cardboard blank 20 makes use of conventional means for making and defining the various bend lines 22, 24, 26 and 28 and the slits or slots 32. The areas of weakened or crushed corrugation 36 are easily formed by striking the cardboard sheet with a blunt ended tool of suitable cross-section, such as a circular end face. The pressure or force with which the cardboard is strucked by the blunt tool should be sufficient to at least partially crush the interior corrugations of the cardboard which corrugations provide rigidity to the board. When so crushed, the cardboard is deprived of rigidity within well defined limited areas 36 so that the cardboard yields within those areas as the accordion fold is hinged into its V-shaped configuration and then folded along the lines 28 to direct the box 10, guiding the corner portions of the V-fold into the aforementioned overlapping S-fold arrangement.

While a preferred embodiment of the invention has been shown and illustrated for purposes of clarity and example, it will be understood that various changes, modifications and substitutions can be made to the described embodiment without thereby departing from the scope and spirit of the present invention, which is defined and limited only by the following claims.

What is claimed is:

1. For making a collapsible container, a sheet of corrugated cardboard cut and scored transversely to a longitudinal dimension to define a plurality of wall panels and a plurality of flaps foldable for making a rectangular box with a bottom, one or more accordion folds extending longitudinally on said sheet, each said fold including parallel crease lines on a common side of said sheet and an intermediate crease line on an opposite side of said sheet and diagonally opposed areas of crushed corrugation in said cardboard adjacent to each intersection of said intermediate crease with said transverse creases.

2. The article of claim 1 said sheet having opposite side edges and further comprising diagonally opposite areas of crushed corrugation at the intersection of said intermediate crease line with said side edges.

3. A method for making a collapsible container comprising the steps of:

providing a sheet of corrugated cardboard cut and scored transversely to a longitudinal dimension to define a plurality of wall panels and a plurality of flaps foldable for making a rectangular box with a bottom, forming one or more accordion folds extending longitudinally on said sheet by making for each said fold parallel crease lines on a common side of said sheet and an intermediate crease line on an opposite side of said sheet; and at least partially crushing the corrugated cardboard to diminish the stiffness of said corrugations within relatively small diagonally opposed areas adjacent to each intersection of said intermediate crease with said transverse creases.

4. The method of claim 3 wherein said sheet has two opposite side edges and further comprising the step of at least partially crushing the corrugated cardboard within diagonally opposite areas at the intersection of said intermediate crease line with the opposite side edges of the sheet.

5. A container having a plurality of corrugated cardboard walls joined along corner edges, said container being collapsible along a dimension parallel to said corner edges of the container by means of one or more accordion folds transverse to said dimension, each said fold including parallel crease lines on a common side of said walls and an intermediate crease line on an opposite side of said walls, and diagonally opposed areas of weakened corrugation in said walls adjacent each intersection of said intermediate crease with said corner edges, such that portions of said accordion fold tend to overlap at said corner edges to facilitate bellowing action of said accordion fold.

6. A method for making a collapsible container of sheet material stiffened by corrugations and having a plurality of walls joined along one or more corner edges, comprising the steps of:

making one or more accordion folds transverse to said one or more corner edges, each said fold including parallel crease lines on a common side of said walls and an intermediate crease line on an opposite side of said walls; and weakening the stiffness of said material at diagonally opposed areas in said walls adjacent each intersection of said intermediate crease with each of said corner edges by at least partially crushing said corrugations with a blunt ended tool, such that portions of each said accordion fold tend to overlap at said corner edges;

whereby said container is made collapsible along a dimension parallel to said corner edges.

* * * * *